United States Patent [19]

Ericson

[11] 4,221,381

[45] Sep. 9, 1980

[54] RESPIRATORY EXERCISER

[75] Inventor: Richard E. Ericson, Harvard, Mass.

[73] Assignee: Albany International Corp., Menands, N.Y.

[21] Appl. No.: 972,778

[22] Filed: Dec. 26, 1978

[51] Int. Cl.[3] ..... A63B 23/00; A61B 5/08

[52] U.S. Cl. ..... 272/99; 128/727; 73/239

[58] Field of Search ..... 128/727, 725; 272/99; 73/239

[56] References Cited

U.S. PATENT DOCUMENTS

| | | | |
|---|---|---|---|
| 3,635,214 | 1/1972 | Rand et al. | 128/727 |
| 3,695,608 | 10/1972 | Hanson | 128/725 X |
| 3,720,202 | 3/1973 | Cleary | 128/727 |
| 3,754,546 | 8/1973 | Cooper | 128/727 |
| 3,848,585 | 11/1974 | Otsap et al. | 128/727 |
| 4,025,070 | 3/1977 | McGill et al. | 128/727 X |
| 4,114,607 | 9/1978 | Russo | 272/99 X |
| 4,138,105 | 2/1979 | Hunger et al. | 128/725 X |

*Primary Examiner*—Lee S. Cohen

*Attorney, Agent, or Firm*—Kane, Dalsimer, Kane, Sullivan & Kurucz

[57] ABSTRACT

A respiratory exerciser which includes a hollow tubular body having at least two openings at one end and an opening at the other end. A piston is reciprocally slidable in the tubular body. A mouthpiece assembly is removably connectable to one opening at the one end of the body so that when the patient inhales and exhales the piston will reciprocate accordingly. Adjustment structure is on the one end to regulate the size of at least another of the openings therein to control the size of the access opening to atmosphere at the one end as the patient breathes through the mouthpiece assembly. An indicator is associated with the adjustment structure to designate the relative size of the access opening to atmosphere at the one end. The structure permits use of the device as an exerciser for inhaling or exhaling and provides adjustment for accommodating changes in strength required by the patient in the exhaling and inhaling exercises.

16 Claims, 4 Drawing Figures

RESPIRATORY EXERCISER

BACKGROUND OF THE INVENTION

In respiratory care environments, throughout the years it has been found to be advantageous to provide various types of respiratory exercisers such as spirometer and lung exercisers to improve respiratory difficulties with various types of patients. Many different types of devices and systems have been developed, some less portable and more costly and others more inexpensive and more readily transportable to different locations. Additionally, with the advent of disposability various types of disposable, portable and inexpensive respirators have been introduced to the market.

Examples of various types of exercisers and spirometers which have been developed include those depicted and described in U.S. Pat. Nos. 3,958,565; 3,826,247; 3,720,202; 3,635,214; 3,810,461; and 4,025,070. A review of these references readily demonstrates the nature and development in the field under consideration.

In general, lung exercisers, sometime called respiratory exercisers or incentive spirometers are designed for purposes including the assistance of patients with lung problems due to lung deseases or possibly only weak lungs due to periods of inactivity in a hospital, for example. The types of devices vary, one type requires the patient to blow into the device, a second type of device requires the patient to inhale so that the device acts as a suction device. The devices are designed so that variability of calibration is possible to adjust for the relative strength or weakness of the patient and to measure recovery progress.

SUMMARY OF THE INVENTION

With the above background in mind, it is among the primary objectives of the present invention to provide a respiratory exerciser device of the incentive spirometer concept and usable as a lung exerciser which is capable of being utilized by the patient in both inhaling and exhaling actions so that it can operate as a positive pressure responsive device and a suction device. Additionally, the device is designed to be adjustable with calibrated settings to adapt the device to the breathing condition of the patient and also to enable measurement of the patient's progress while exercising with the device to improve his breathing condition. The device is particularly adaptable for use with patients having lung problems due to lung desease or even simply weak lungs due to periods of inactivity in a hospital.

The device of the invention is lightweight and portable and lends itself to disposability by being formed of inexpensive lightweight material. It also lends itself to disposability due to simple inexpensive construction and the ability to be formed of plastic material.

Adjustability is achieved by use of slots or holes in one end of a tubular body positioned to be brought into and out of alignment with an appropriate slot in a dial cap mounted on the one end. Appropriate calibration means are provided for indexing the relative position of the holes or slot in the body and the slot in the rotatable dial cap to facilitate indexing of the relative position and adjusting the capability of introduction of atmospheric air into and out of one end of the body for controlling the degree of effort required in the breathing operation of the patient.

The device is designed so that the patient breathes through a mouthpiece assembly which is attached to a separate opening in the one end of the body portion so that his breathing, in either the inhaling or exhaling direction, will adjust the air pressure conditions within the tubular body. A slidable piston is in the body responsive to the aspiration activity of the patient and coordination between the air passed through the aligned openings in the one end of the body and the breathing action of the patient will determine the difficulty for the patient in shifting the piston along the tubular body as he inhales and exhales. The device is designed so that the other end of the body portion has an opening and the piston has clearance with respect to the inner walls of the tubular body so that air can move from one side of the piston to the other as the piston is shifted along the tubular body in response to breathing of the patient.

The lightweight and compact device, adaptable for portability, includes a pocket clip on the exterior surface of the tubular body for assisting in mounting the device for transportation from one location to another.

The mouthpiece assembly for the patient is designed with a typical conventional mouthpiece at one end and a conventional flexible hose terminating in a connector cuff at the other end for mounting on an open ended neck portion of the tubular body. A frictional connection is made between the connector cuff of the hose and the extended open ended neck portion of the body whereupon interconnection therebetween provides communication between the interior of the hose and the interior of the tubular body and, accordingly, between the patient and the interior of the body of the exerciser.

The body can be inexpensively manufactured with openings at both ends and formed with a dial cap easily rotatably coupled and indexed with respect to the openings in one end of the tubular body and an end cap with an opening therein mountable on the other end of the tubular body to cooperate with the opening therein to form a stationary open end.

In summary, the respiratory exerciser of the present invention includes a hollow tubular body having at least two openings at one end and an opening at the other end. A piston is reciprocally slidable in the tubular body. A mouthpiece assembly is removably connectable to one opening at the one end of the body so that when the patient inhales or exhales the piston will reciprocate accordingly. An adjustment assembly is on the one end to regulate the size of at least a second opening in the one end of the body to control the size of the access opening to atmosphere at the one end as the patient breathes through the mouthpiece assembly. An indicator is associated with the adjustment assembly to designate the relative size of the access opening to atmosphere at the one end.

With the above objectives among others in mind, reference is made to the attached drawings.

DETAILED DESCRIPTION

Figure 1:
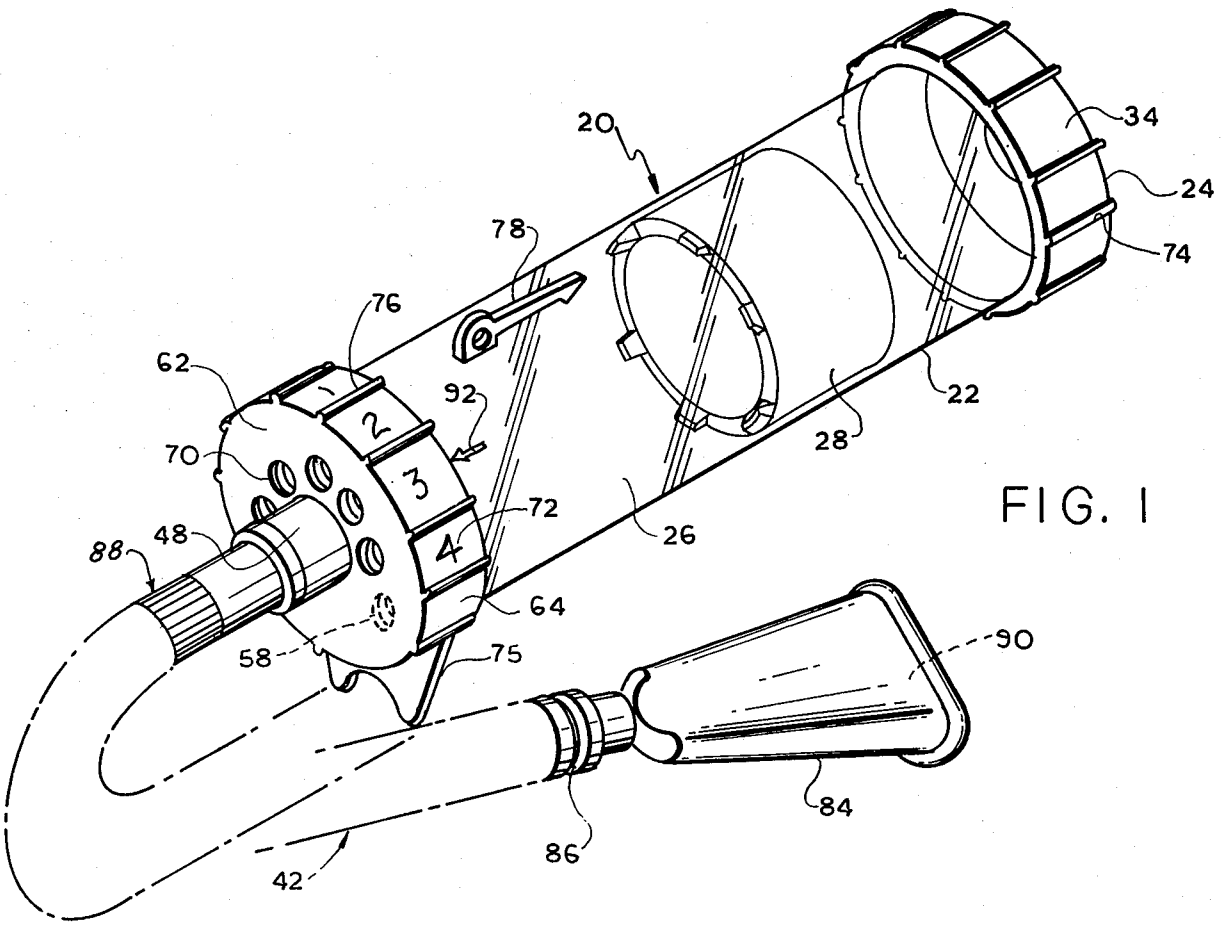
FIG. 1 is a schematic view of the respiratory exerciser of the invention.
Figure 2:
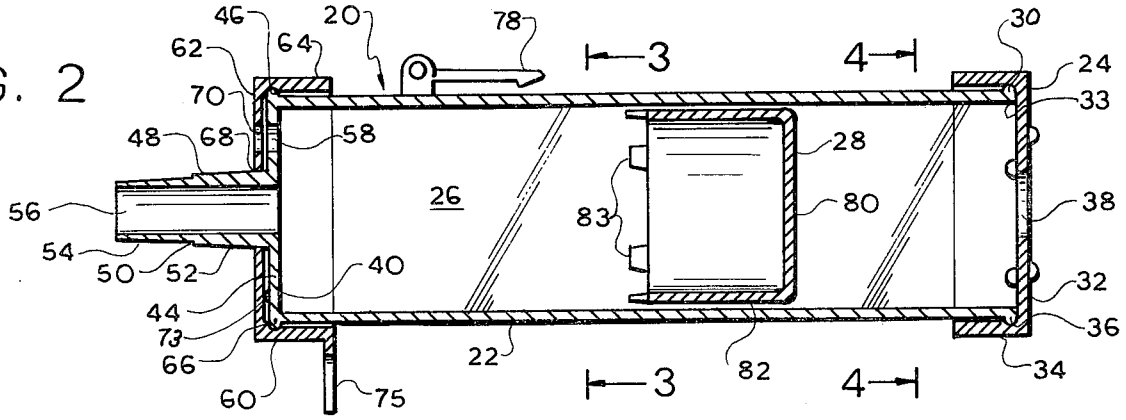
FIG. 2 is a sectional side view of the respiratory exerciser of the invention with the mouthpiece assembly removed therefrom.
Figure 4:
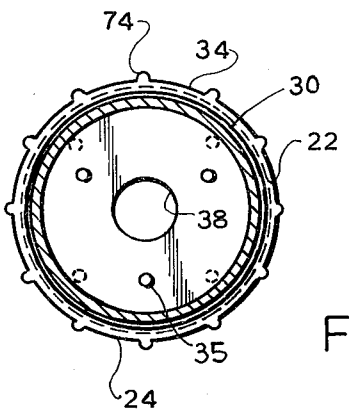
FIG. 4 is a sectional end view thereof taken along the plane of line 4—4 of FIG. 2.
Figure 3:
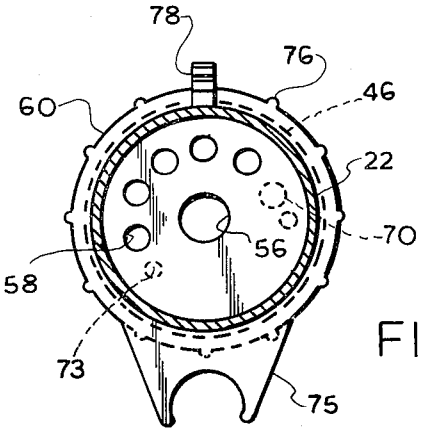
FIG. 3 is a sectional end view thereof taken along the plane of line 3—3 of FIG. 2.

Respiratory exerciser 20 includes a transparent tubular body 22 covered at one end by means of an end cap 24 mounted in fixed position thereon. The interior of body 22 is hollow to form an interior chamber 26. Mounted in the interior chamber 26 is a reciprocally movable slidable disc-shaped piston 28. The outer diameter of piston 28 is slightly smaller than the inner diameter of the inner wall of tubular body 22 so that air can pass therebetween and the piston can slide freely in an axial direction and reciprocally within the tubular body 22. Additionally, the piston could be provided with small open passages for facilitating by-pass air flow when in use.

At the covered rear end of tubular body 22 the tubular body is formed initially with an open end and a peripheral bead 30 surrounding the open rear end 33. The fixed cap 24 includes a disc-shaped base 32 and a peripheral depending skirt 34. An annular recess 36 is positioned at the joint of the skirt 34 and the base 32 at the inner surfaces thereof to accommodate the bead 30. This forms an interlocking relationship when the fixed end cap 24 is snapped into position on the open rear end 33 of tubular body 22. To permit communication to atmosphere, a central opening 38 is in the base portion 32 of end cap 24.

The forward end portion 40 of tubular body 22 which is designed for interconnection with a mouthpiece assembly 42 is formed with an end wall 44 and a surrounding peripheral bead 46 thereon. Centrally located within the end wall is a forwardly extending tapered neck 48 which is provided with an intermediate step 50 so that the neck 48 has a larger diameter portion 52 adjacent to wall 44 and a smaller diameter tapered neck portion 54 terminating in a narrower diameter open end 56. The neck 48 is hollow so that communication is provided between open end 56 and the interior 26 of the tubular body.

At a predetermined location on the surface of end wall 44 of forward end 40 of the body is an arcuate arrangement of side by side holes 58 which serves as part of an adjustment means to regulate the passage of atmospheric air passing into and out of the chamber 26 of the tubular body as the patient operates the exerciser 20. It has been found that an arrangement of holes provides for greater strength in end wall 44, however, alternative arrangements for an opening can be provided such as the use of an arcuate slot in place of the arrangement of holes 58.

Mounted on forward end 40 of tubular body 22 is a rotatable dial cap 60 which has a disc-shaped base 62 and an annular skirt 64 depending therefrom. An inner recess 66 is located at the joining inner surfaces of the base 62 and the skirt 64 to accommodate the annular bead 46 on the forward end portion of tubular body 22. In this manner, the dial cap 60 can be mounted by snapping it into position on the forward end portion of body 22.

The dial cap is placed in position by passing neck 48 through a central aperture 68 in base wall 62 of the dial cap.

The dial cap is also provided with an arcuate arrangement of holes 70 located so that they can be brought into and out of alignment with the arrangement of holes 58 in the end wall 44 of tubular body 22 when the dial cap is positioned thereon. Cooperation between holes 70 and holes 58 as the dial cap is rotated with respect to the tubular body provides for alteration in the size of area of opening to atmosphere at the forward end 40 of the tubular body thereby adjusting the ease of operation for the patient in using the exerciser. Alternatively, a slot can be substituted for holes 70 to achieve a similar result in a similar manner.

The dial cap is also provided with an arrangement of indicia 72 which cooperates with an index marker on the mouthpiece assembly 42 or body 22 to provide instant designation for the user as to the relative position of the holes 58 with respect to the holes 70 and thereby providing for adjustment and identification of the area of opening to atmosphere at the forward end 40 of the tubular body of exerciser 20.

Two projections 73 are on the inner surface of the end wall 44 of the dial cap to slightly space the major portion of end wall 44 from the adjacent end wall of the body and facilitate ease of rotation of the dial cap with respect to the body. Naturally, the number and nature of the projections is a matter of choice and could be on the body instead of the cap or, other well known spring means can be employed for the same purpose.

A storage clip 75 extends from the skirt of the dial cap for releasably holding the hose of the mouthpiece assembly 42 when not in use.

It will also be noted that the outer surface of the skirt portion 34 of end cap 24 has an interrupted surface which may be formed either by a series of flutes 74 which forms a knurled surface, as shown, or by projections or roughened portions or other similar means to facilitate handling and snapping of the end cap in position on the rear open end 33 of the tubular body. A series of flutes 76 or a similar interrupted surface as provided on cap 24 is on the outer surface of skirt 64 of dial cap 60 for the same purpose, that is handling and mounting of the dial cap in position on the forward end 40 of the tubular body and also for facilitating rotation of the dial cap to operate the adjustment means provided by the alignment of holes 58 and holes 70.

The outer surface of tubular body 22 also contains a pocket clip 78 mounted thereon in conventional fashion, such as by adhesive, or integrally formed thereon to facilitate mounting and transporting the body portion of respirator 20 when it is transported between locations.

The piston 28 includes a disc-shaped end wall 80 facing the rear end of tubular body 22 and a peripheral skirt 82 extending therefrom toward the forward end of tubular body 22. Thus, the breathing action of the patient will directly contact the disc-shaped face of the piston. If desired, the piston orientation can be reversed. This facilitates operative movement of the piston with respect to the breathing exercises of the patient. The piston is thus a relatively hollow element with end wall 80 and skirt 82 forming the entire surface area. The skirt 82 is provided with clearance with respect to the inner wall of tubular body 22 thus providing for ease of movement of the piston and for clearance of air to pass thereby in both directions as the patient inhales and exhales.

Spacing means is provided at both ends of the assembly to prevent the piston from sealing against either end wall in its travel from end to end in the tubular body thus retaining the air flow passageways at both ends at all times. In the depicted embodiment, an arrangement of six spaced tabs 83 extend from the free end of skirt 82 for engagement with the end wall 44 of the body to space the piston from that end wall.

An arrangement of three projections 35 extend inwardly from base wall 32 of end cap 24 to engage with piston end wall 80 for a similar purpose. Naturally other spacing means can be employed, for example, annular projections on the body, or projections on any surfaces of the body, piston, and end caps which would otherwise engage thereby retaining those surfaces in separated condition.

Mouthpiece assembly 42 includes a conventional type of mouthpiece 84 integrally formed or connected by a snap fit or frictional fit with one end of a flexible hose 86. The other end of the flexible hose 86 is connected to or integrally formed with a tubular cuff 88. The cuff 88, hose 86, and mouthpiece 84 are hollow so that a continuous open passageway is provided from the open end 90 of the mouthpiece which is placed in the patient's mouth to the open end at the free end of cuff 88. Connector cuff 88 is frictionally engaged with the tapered outer surface of neck 48 thereby providing for communication throughout the length of mouthpiece assembly 42 to the interior chamber 26 of body portion 22 so that when the patient has the mouthpiece 84 placed in his mouth he will be in breathing communication with interior chamber 26 of the exerciser. In the embodiment shown, flexible hose 86 is frictionally engaged with mouthpiece 84 and the cuff 88 is integrally formed on the opposite end of the flexible hose. As stated above, this arrangement is conventional and well known.

The exerciser 20 is then ready for use and, depending upon the condition of weakness of the patient, appropriate adjustment is made with respect to the number of exposed holes 58 accessible through holes 70 in the dial cap. This is indicated by rotating the dial cap 60 until the appropriate number is aligned with an indexing arrow 92 provided on the body of the exerciser 20. The patient then inhales or exhales or both and piston 28 is shifted in response to the breathing action of the patient. Atmospheric conditions are controlled by air passing through exposed holes 58 at one end and the opening 38 at the rear end of the tubular body and the strength of the patient will shift the piston accordingly in an axial direction with respect to the tubular body. As the patient gains strength dial cap 60 can be rotated to a different position thereby adjusting the relative atmospheric conditions on both sides of the piston and making it more difficult or easier as desired for the patient to shift the piston. Thus, in a quick and efficient manner the exerciser can be adapted to accommodate for improvement of the patient's breathing condition and will permit him to exercise by both inhaling and exhaling.

After use, hose 86 is snapped into storage clip 75 and the assembly can be put aside and stored. If the respirator is formed of all disposable material the entire device can be disposed of or it can be reused if constructed of reusable material with appropriate sterilization procedures being carried out for reuse purposes where needed. Pocket clip 78 accommodate ease of transportation and storage of the respirator when not in use. For materials of construction, it has been found to be effective to construct the entire respirator 20 of conventional inexpensive plastic materials.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A respiratory exerciser comprising; a hollow tubular body having at least two openings at one end and an opening at the other end, a piston freely reciprocally slidable in the tubular body, means for allowing said piston to reciprocate in response to fluid pressure caused by patient inhalation and and exhalation, said means including a mouthpiece assembly removably connected to one opening at the one end of the body so that when the patient inhales and exhales the piston will reciprocate accordingly in response to fluid pressure caused by inhalation and exhalation, and adjustment means on the one end to regulate the size of the one other opening in the one end to control the size of an access opening to atmosphere at the one end as the patient breathes through the mouthpiece assembly.

2. The invention in accordance with claim 1 wherein there is indicating means associated with the adjustment means to designate the relative size of the access opening to atmosphere at the one end.

3. The invention in accordance with claim 1 wherein the piston has a slightly smaller diameter than the inner diameter of the walls of the tubular body to facilitate passage of a limited amount of air between both sides of the piston as the patient breathes through the mouthpiece assembly.

4. The invention in accordance with claim 1 wherein the one end of the tubular body includes a reduced diameter hollow extending neck portion with a passageway therethrough to form the one opening removably connected to the mouthpiece assembly at the one end of the tubular body with the mouthpiece assembly being removably connected to the surface of the neck portion so that communication is provided between the mouthpiece assembly and the interior of the tubular body.

5. The invention in accordance with claim 1 wherein there is an end wall at the one end of the tubular body, the one other opening in the tubular body is at least one hole formed in the end wall, the adjustment means including a rotatable dial cap removably mounted on the one end portion of the tubular body, the cap having a corresponding at least one hole aligned with respect to the hole in the end wall of the tubular body so that relative rotation therebetween adjusts the size of the access opening between the atmosphere and the interior of the tubular body.

6. The invention in accordance with claim 5 wherein there is indicating means associated with the adjustment means to designate the relative size of the access opening to atmosphere at the one end, the indicating means includes an arrangement of indicia on the rotatable cap indexable with respect to a fixed marking on the body so as to coordinate indicia with the size of the access opening to atmosphere at the one end.

7. The invention in accordance with claim 5 wherein the hole in the end wall of the tubular body is in the form of a plurality of holes side by side and slightly spaced with respect to one another.

8. The invention in accordance with claim 5 wherein separator means is provided between the inner surface of the dial cap and the adjacent surface of the tubular body to provide for minimum contact between the dial cap and the tubular body thereby facilitating rotation of the dial cap with respect to the tubular body.

9. The invention in accordance with claim 8 wherein the separator means is in the form of a plurality of projections extending inwardly from the inner surface of the rotatable dial cap into engagement with surfaces on the adjacent end wall of the tubular body.

10. The invention in accordance with claim 1 wherein the mouthpiece assembly includes a flexible hose with a connector cuff on one end removably connected to the one end of the tubular body to provide communication between the interior of the hose and the interior of the tubular body, a mouthpiece on the other end of the hose in position to provide communication between the interior of the hose and the patient.

11. The invention in accordance with claim 1 wherein the respiratory exerciser is formed of plastic material and the tubular body is transparent.

12. The invention in accordance with claim 1 wherein a pocket clip is mounted on the exterior surface of the tubular body to facilitate removable mounting of the exerciser.

13. The invention in accordance with claim 1 wherein the other end of the tubular body is covered by an end cap frictionally mounted thereon and having an opening therein to provide access to the opening at the other end of the tubular body.

14. The invention in accordance with claim 1 wherein spacing means is provided at the ends of the travel path of the reciprocally slidable piston axially along the interior of the tubular body for facilitating the prevention of sealing of the piston against an adjacent wall surface at the end of its travel path thus retaining the air flow passageways at both ends of the tubular body at all times.

15. The invention in accordance with claim 14 wherein the spacing means includes a plurality of spaced tabs extending from one end of the piston in position to engage with wall portions of the tubular body when the piston reaches one end of its travel path, a plurality of projections on surface portions of the other end of the tubular body for engagement of the adjacent side of the piston when the piston reciprocates fully in the opposite direction thereby retaining the air flow passageways at both ends of the exerciser at all times.

16. The invention in accordance with claim 1 wherein the respiratory exerciser includes a storage clip in position for releaseably holding a portion of the mouthpiece assembly when the respiratory exerciser is not in use.

* * * * *